US005487765A

United States Patent [19]

Kedar et al.

[11] Patent Number: 5,487,765

[45] **Date of Patent: *Jan. 30, 1996**

[54] APPARATUS FOR PURGING NON-CONDENSABLE GASES FROM CONDENSERS

[75] Inventors: Alon Kedar, Nes Ziona; Ohad Zimron, Rishon Lezion, both of Israel

[73] Assignee: Ormat Turbines (1965) Ltd., Yavne, Israel

[ * ] Notice: The term of this patent shall not extend beyond the expiration date of Pat. No. 5,113,927.

[21] Appl. No.: 274,577

[22] Filed: Jul. 13, 1994

Related U.S. Application Data

[63] Continuation of Ser. No. 74,144, Jun. 9, 1993, abandoned, which is a continuation of Ser. No. 878,903, May 6, 1992, abandoned, which is a continuation-in-part of Ser. No. 675,865, Mar. 27, 1991, Pat. No. 5,113,927.

[51] Int. Cl.[6] ..... B01D 35/01

[52] U.S. Cl. ..... 55/310; 96/165; 165/104.27; 165/917

[58] Field of Search ..... 55/310, 269, 311, 55/267; 165/13, 111, 104, 27, 917, 112, 113; 96/157, 165, 168; 60/275; 62/85, 475

[56] References Cited

U.S. PATENT DOCUMENTS

| | | | |
|---|---|---|---|
| 2,598,799 | 6/1952 | Kiene | 62/3 |
| 3,230,729 | 1/1966 | Eber | 62/195 |
| 4,385,909 | 5/1983 | Starr | 55/189 |
| 5,113,927 | 5/1992 | Kedar | 165/111 |
| 5,119,635 | 6/1992 | Harel | 60/692 |

FOREIGN PATENT DOCUMENTS

| | | |
|---|---|---|
| 0038958 | 11/1981 | European Pat. Off. . |
| 0405961 | 1/1991 | European Pat. Off. . |
| 2095320 | 2/1972 | France . |
| 1926395 | 11/1970 | Germany . |
| 950750 | 2/1964 | United Kingdom . |

OTHER PUBLICATIONS

Armstrong Guide To Refrigerated Purging, Economical, automatic removal of power–robbing, efficiency–sapping air from refrigerating systems, Bulletin 702–B, pp. 1–16.

*Primary Examiner*—Richard L. Chiesa

[57] ABSTRACT

Apparatus for purging non-condensable gases from a condenser containing vaporized, condensable working fluid, includes an enclosed chamber located above the condenser, a movable diaphragm in the chamber for dividing the latter into upper and lower portions, two flow control valves serially connected together and located between the condenser and the lower portion of the chamber, and a venting valve connected to the lower portion. Each of the valves are selectively operable and have an open and a closed state. A mechanism is provided for moving the diaphragm for changing the volume of the lower portion; and a mechanism is provided for synchronizing the states of the valves with changes in the volume of the lower portion.

39 Claims, 3 Drawing Sheets

CONTROL "a"

HYDRAULIC OR ELECTRICAL ACTUATOR
40
30A
41
36
39
49
31
35
38
34
37
COOLANT IN
COOLANT OUT
V3
50
RELIEF VALVE
48
46
CONTROL "d"
V1
CONTROL "b"
45
V2
CONTROL "c"
47
CONDENSER
16a

APPARATUS FOR PURGING NON-CONDENSABLE GASES FROM CONDENSERS

This application is a continuation of application Ser. No. 08/074,144, filed Jun. 9, 1993, now abandoned, which is Continuation of Ser. No. 07/878,903 filed on May 06, 1992 now abandoned, which is a continuation-in-part of prior application Ser. No. 07/675,865, filed Mar. 27, 1991, which issued as U.S. Pat. No. 5,113,927 on May 19, 1992.

TECHNICAL FIELD

This invention relates to a method of and means for purging non-condensable gases from a condenser or the like.

BACKGROUND ART

Non-condensable gases almost always cause problems in Rankine cycle power plants, in air conditioning systems, and in other arrangements that utilize condensers, and in other systems. A major problem caused by the presence of non-condensable gases is a reduction in the heat transfer efficiency of various components in a system. That is to say, the presence of non-condensable gases in the working fluid of the system reduces the rate at which heat can be transferred from a heat source to the working fluid in a vaporizer of a Rankine cycle power plant, as well as the rate at which heat can be transferred from vapor to a cooling fluid in a condenser of a Rankine cycle power plant. The deleterious effect non-condensable gases have on the operation of a power plant is illustrated by the example described below of an actual operational system.

Waste heat is applied to a vaporizer of a Rankine cycle power plant utilizing isopentane, or normal pentane, as the working fluid. The vaporizer vaporizes the working fluid and supplies it to an organic vapor turbine designed to produce 1.5 MW by driving an electric generator. In the turbine, the vapor expands producing work and heat depleted working fluid which is supplied to a condenser. In the condenser, the heat depleted working fluid is condensed into a liquid which is pumped back into the vaporizer to repeat the cycle.

Except during very cold periods of time, the internal pressure at various locations in the power plant described above, including the condenser, will exceed atmospheric pressure. Nevertheless, even under these conditions, experience proves that ambient air leaks into the working fluid through the metal piping, flanges, joints, etc. Apparently, air diffuses through the metal piping and seals even when the pressure inside the system exceeds atmospheric pressure.

The effect on the power output of a power plant having non-condensable gases in the working fluid is significant. For example, in relatively small systems designed to produce about 1.5 MW, experience has shown more than a 10% decrease in power may result if a constant program of purging non-condensable gases from the system is not carried out, an amount that is significant in terms of the total power output.

The conventional approach to purging non-condensable gases from the condenser of a power plant of the type described is to utilize a vacuum pump arrangement by which fluid (vaporized working fluid and non-condensable gases) in the condenser is admitted to a cooled chamber. The result is a miniature condenser wherein the working fluid condenses and is thus separated from the non-condensable gases which are vented from the chamber before the condensed working fluid is returned to the system.

While this approach is satisfactory in some instances, it is unsatisfactory in many instances because of the power consumption involved, and because of the complex equipment needed to establish and maintain a vacuum. Furthermore, the conventional approach is insensitive to the amount of non-condensable gases in the power plant system requiring continuous operation that, itself, is a disadvantage in many cases. Furthermore, experience proves that extraction of non-condensable gases requires operation of the purging system over long periods of time because the non-condensable gases often are dissolved in the working fluid, and only slowly are released and extracted in the purging system associated with the condenser. Thus, constant operation is often required to ensure removal of these gases. Also, during cooling of the fluid in the cooled chamber, even though a substantial portion of the working fluid is condensed and returned to the system, a large portion of working fluid remains in vapor form and is extracted together with the non-condensable gases during the operation of the vacuum pump. This portion is lost to the system.

It is therefore an object of the present invention to provide a new and improved method of an means for purging non-condensable gases from a condenser, or from a system containing a condenser, or from any system whose performance is affected by the presence of non-condensable gases, and which is more efficient than other systems previously known, simpler to maintain control and operate, more sensitive to the actual amount of non-condensable gases in the system, and effective in substantially minimizing the amount of working fluid lost from the system.

BRIEF DESCRIPTION OF THE INVENTION

Apparatus in accordance with the present invention for purging non-condensable gases from a condenser or the like containing vaporized working fluid includes a chamber, and a valve having an open state for connecting the condenser to the chamber, and having a closed state for disconnecting the condenser from the chamber. Associated with the chamber is an element, made effective when the valve is in its closed state, to condense working fluid in the chamber thereby separating the same from non-condensable gases in a chamber. A selectively operable vent connected to the chamber permits the latter to be vented when the valve is in its closed state. A relief valve connected to the vent substantially prevents extraction of working fluid from the system when no non-condensable gases are present in the chamber.

The apparatus according to the invention thus provides for the extraction of fluid from the condenser, the fluid containing both vaporized working fluid and non-condensable gases. The fluid so extracted from the condenser is pressurized in such a way that the working fluid is liquefied and separated from the non-condensable gases. Loss of working fluid from the system being purged is substantially prevented or minimized.

In a particular embodiment of the present invention, apparatus for purging non-condensable gases from a condenser containing vaporized, condensable working fluid, includes an enclosed chamber, preferably connected to the portion of the condenser where non-condensable gases accumulate and usually located above the condenser, a movable diaphragm in the chamber for dividing the latter into upper and lower portions, two flow control valves serially connected together and located between the condenser and the lower portion of the chamber, and a venting valve connected to the lower portion. Each of the valves are selectively operable and have an opened and a closed state. Means are provided for moving the diaphragm for changing the volume of the lower portion; and means are provided for synchronizing the states of the valves with changes in the volume of said lower portion.

The means for synchronizing is such that the flow control valve closer to the condenser is operated to change its state from opened to closed when the volume of the lower portion of said chamber begins to decrease from its maximum value in response to movement of diaphragm while the flow control valve closer to the chamber remains in its open state whereby fluid in said lower portion is compressed as the volume thereof reaches a minimum. Vaporized working fluid in the lower portion thus condenses to a liquid that flows into the region between the two flow control valves.

The means for synchronizing is such that the flow control valve closer to the chamber is operated to change its state from opened to closed, and thereafter the venting valve is operated to vent the lower portion of the chamber thereby removing non-condensable gases therefrom. Liquid present in the region between the two flow control valves drains back into the condenser when the valve closer to the condenser is opened.

BRIEF DESCRIPTION OF THE DRAWINGS

An embodiment of the present invention is shown by way of example in the accompanying drawings wherein.

DETAILED DESCRIPTION OF THE PREFERRED EMBODIMENTS

Figure 1:
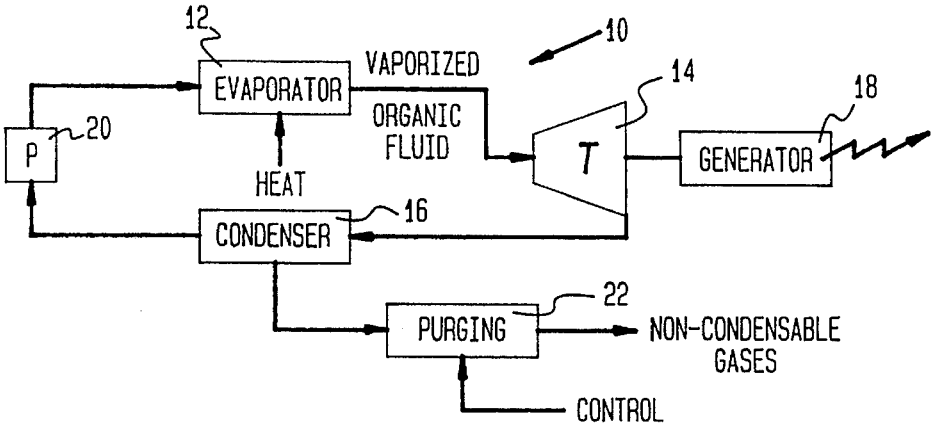
FIG. 1 is a block diagram of a Rankine cycle power plant utilizing an organic working fluid showing, in general form, the application of the present invention to the power plant.

Turning now to the drawings, reference numeral 10 designates a Rankine cycle power plant according to the present invention wherein the purging of non-condensable gases from the condenser of the power plant is achieved by using purging system 22. Power plant 10 comprises vaporizer 12 to which heat is applied for evaporating a working fluid such as an organic liquid (e.g., isopentane, n-pentane, or other hydrocarbon, or halogenated hydrocarbon). The heat may be waste heat from an industrial process, heat contained in natural sources such as geothermal fluid, or may be from the burning of natural or manufactured fuel.

Vaporized working fluid produced by vaporizer 12 is applied to organic vapor turbine 14 in which the vaporized working fluid expands and produces work and heat depleted working fluid which is supplied to condenser 16. Work produced by the turbine drives electrical generator 18 which supplies power to an electrical grid (not shown). A typical system would require turbo-generator 14/18 to produce maximum rated power over long periods of time with a minimum of maintenance. Heat depleted working fluid in condenser 16 is cooled, by air or cooling water; and the working fluid condenses into a liquid that is returned to vaporizer 12 by pump 20 where the cycle repeats.

From experience, it has been found that one of the causes of a power reduction under conditions of fixed heat input and ambient temperatures, is a build-up of non-condensable gases in the condenser and elsewhere in the system. Such build-up reduces the heat transfer coefficients in the various heat exchangers in the power plant to a point where the power produced drops below its expected value.

In order to maintain the power produced by power plant 10 at substantially its expected value, purging system 22, according to the present invention, operates in the manner described below by extracting fluid from the condenser. Such fluid is a mixture of heat depleted vaporized working fluid and non-condensable gases; and the fluid is externally compressed in such a way that the working fluid is liquefied and separated from the non-condensable gases.

The liquefied working fluid is returned to the condenser, and the non-condensable gases are vented. This operation is carried out periodically, preferably in accordance with a series of control signals, e.g., every 20 minutes, to substantially purge the non-condensable gases and thus substantially maintain the power level of the power plant. Alternatively, such operation can be carried out using a monitor (not shown) monitoring the power level of generator 18 which determines that the power output thereof returns to its set level, i.e., until the amount of non-condensable gases in the system is reduced to a level at which minimal effect is exerted by the gases on the efficiency of the power plant.

Figure 2:
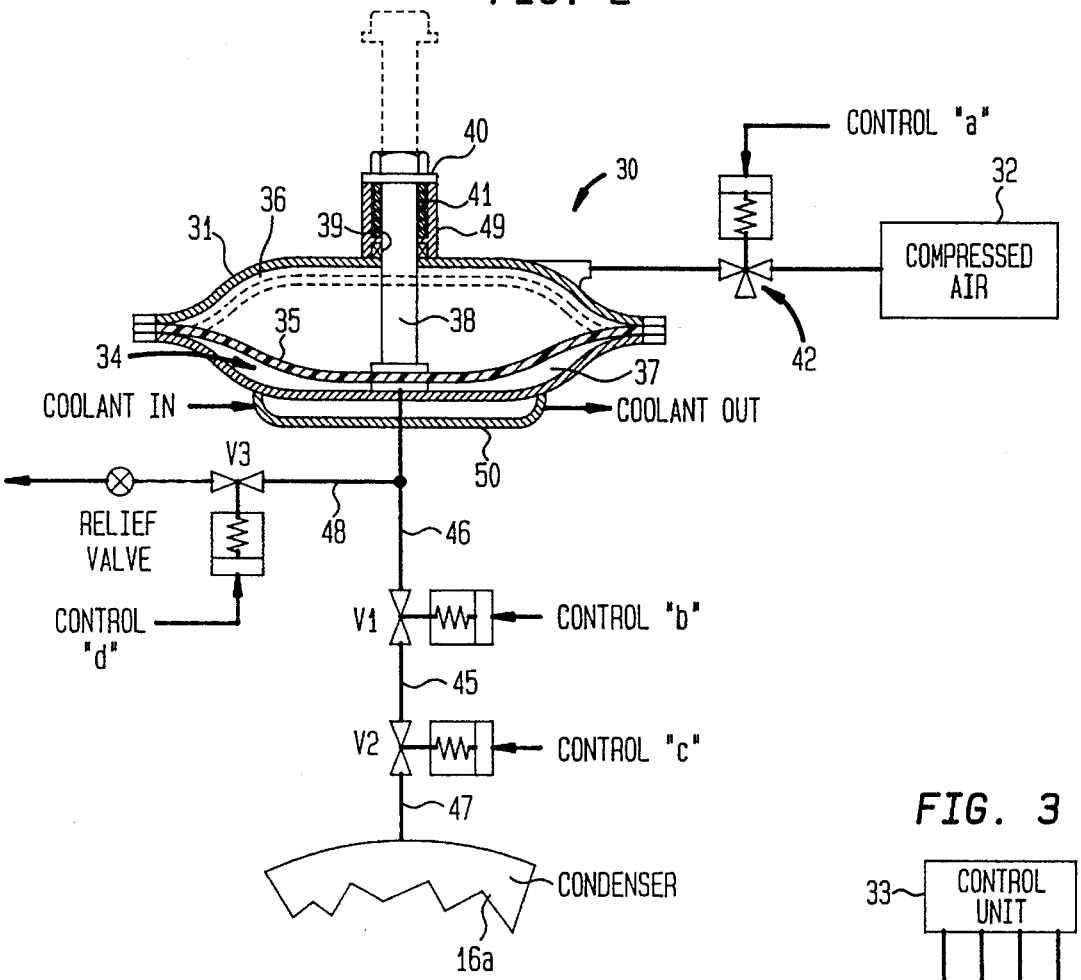
FIG. 2 is a schematic diagram, partly in section, and showing parts partly broken away, illustrating an embodiment of the present invention.
Figure 3:
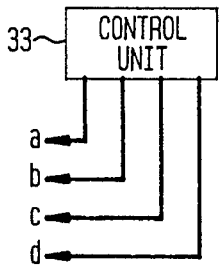
FIG. 3 is a schematic showing of a control unit for synchronizing changes in volume of a lower portion of a chamber of the embodiment of FIG. 2 with operation of the various valves of the embodiment.

Purging apparatus according to the present invention is shown by way of example in FIG. 2 and designated by reference numeral 30. Apparatus 30 comprises housing 31, valves V1, V2, V3, compressed air source 32, control unit 33, and associated piping and control lines. Preferably, housing 31 is connected to an upper portion of condenser 16A.

Housing 31, which is located at a higher elevation than condenser 16A, defines closed chamber 34, and includes flexible diaphragm 35 that divides the chamber into upper portion 36 and lower portion 37. Operating rod 38 is attached to the central region of the diaphragm and extends axially upwardly through upper portion 36 of the chamber passing through seal 39 in housing 31 and extending above the top of the housing. Rod 38 terminates in enlarged head 40. Captured between the enlarged head and the bottom of upper spring housing 49 positioned above the top of the housing is compression spring 41 which is compressed when the diaphragm is positioned to minimize the volume of lower portion 37, and is unstressed when the diaphragm is positioned to maximize the volume of the lower portion of the chamber. Thus, absent any other forces acting on the diaphragm, spring 41 serves to position the diaphragm as indicated by the chain lines in FIG. 2, and the volume of the lower portion of the chamber is a maximum.

Control of the position of the diaphragm is achieved by selective operation of valve 42 which has one state that connects compressed air source 32 to upper portion 36, and another state that disconnects source 32 from the upper portion for venting the latter to the atmosphere. Control signals "a" generated by control unit 33 selectively operate valve 42. When control signal "a38 causes valve 42 to connect source 32 to the upper portion of the chamber, diaphragm 35 moves downwardly from its position shown by the chain lines in FIG. 2 to its position shown in solid lines, against the upward force exerted by spring 41. The volume of the lower portion of the chamber thus changes from a maximum to a minimum. When control signal "a" causes valve 42 to vent upper portion 36, spring 41 is effective to move the diaphragm from its minimum volume to its maximum volume.

Flow control valves V1 and V2 are selectively operable by control signals "b" and "c" produced by control unit 33 as indicated, and each has an opened and a closed state. These valves are serially connected by conduit 45, and are located between the upper portion of condenser 16A and lower portion 37 of chamber 34 of housing 31. Specifically conduit 46 connects valve V1 to the lower chamber, and conduit 47 connects valve V2 to the condenser.

Venting valve V3, selectively operated by control signal "d", serves to selectively vent lower portion 37 of the chamber. To this end, valve V3 may be connected by conduit 48 to conduit 46 above valve V1, as shown in FIG. 2, or may be connected directly to the lower chamber. Relief valve 49 is connected to valve V3.

Finally, apparatus 30 may include means to cool lower portion 37 of chamber 34. In such case, the lower part of housing 31 is provided with cooling tubing 50 which surrounds lower portion 37 and receives flowing coolant, such as water, for extracting heat from the fluid in lower portion 37 during compression of the fluid.

The basic function of apparatus 30 is to periodically connect the condenser to the lower portion of the chamber, to draw fluid (i.e., vaporized working fluid and any non-condensable gases that may be present) from the condenser into lower portion of the chamber, to isolate the lower portion from the condenser, to compress and cool the fluid trapped in the lower portion thereby condensing the vaporized working fluid component in the trapped fluid and producing liquid working fluid, to drain the liquid working fluid into the condenser, and to vent the lower portion to the atmosphere, for example, to remove non-condensable gases trapped in the lower portion. This operation is carried out by synchronizing the states of valves V1, V2, V3 with changes in the volume of the lower portion of the chamber caused by selective operation of valve 42.

Figure 4:
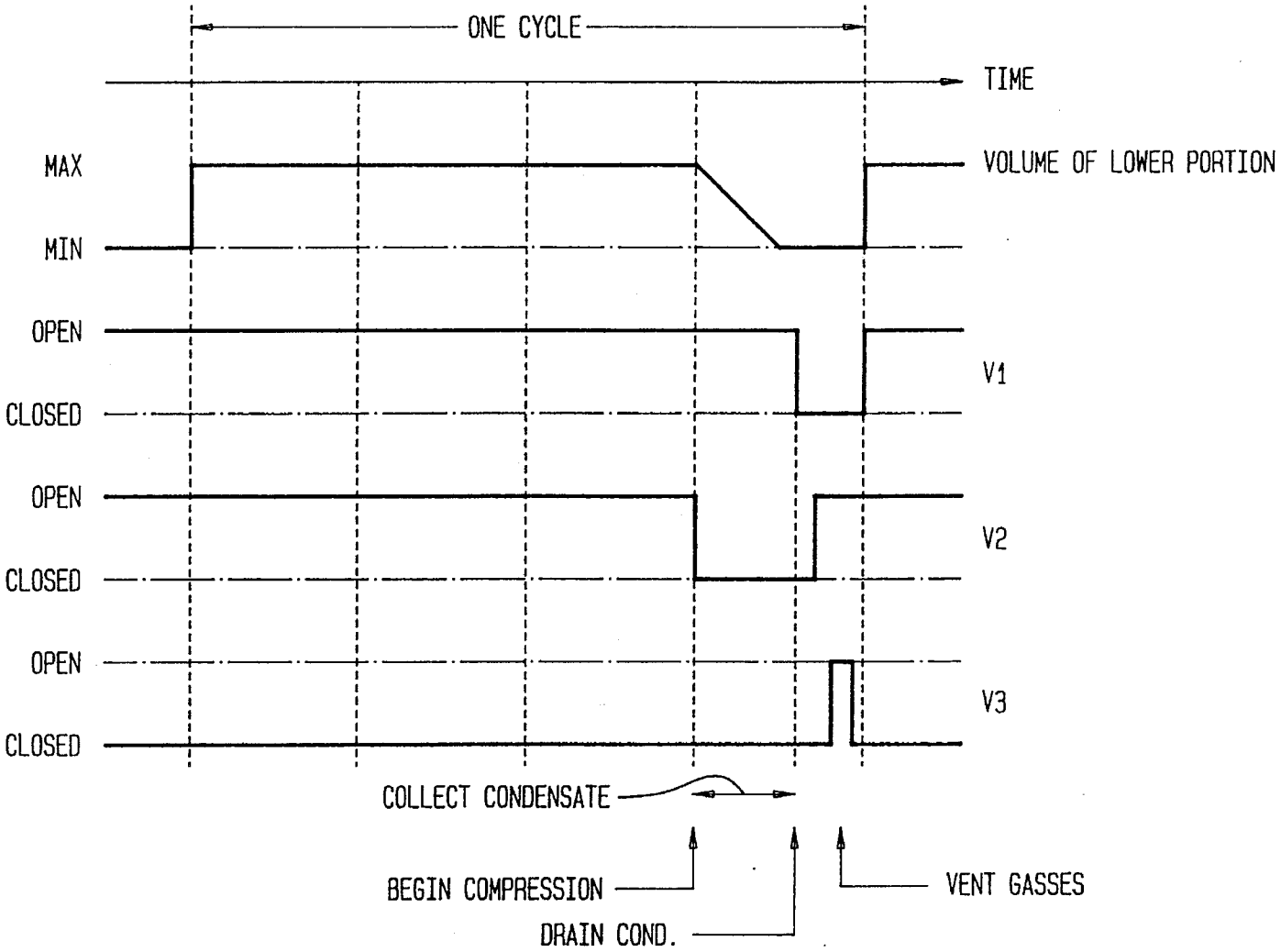
FIG. 4 is a timing chart showing the time relationship of the states of the various valves.

The timed sequence of operation is illustrated in Fig. 4 which shows one cycle of a repeating series of cycles. In operation, at the start of a cycle, valves V1, and V2 are open, valve V3 is closed, and valve 42 vents upper portion 36 of the chamber with the result that the volume of lower chamber 37 is a maximum. Thus, diaphragm 35 is in the position shown in chain lines in FIG. 2. The previous upward movement of the diaphragm permits fluid in condenser 16A to be drawn into chamber 37 through open valves V1 and V2.

After a predetermined period of time, control unit 33 issues control signals "a" and "c". Signal "c" causes valve V2 to close thus trapping fluid in the lower chamber; and signal "a" causes valve 42 to admit air from source 32 into upper portion 36 thus causing the diaphragm to begin to move downwardly in the chamber and to begin compression of the fluid trapped in the lower portion. The compression of the trapped fluid, coupled with a cooling effect provided by the coolant circulating in tubing 50, causes the working fluid component in the trapped fluid to condense into a liquid that flows downwardly through open valve V1 into conduit 45 where the fluid is trapped by reason of the closed state of valve V2. The non-condensable gas component in the fluid trapped in lower portion 37 remains trapped because valve V2 is closed.

After compression is complete, control signal "b" is applied to valve V1 changing its state from opened to closed, and signal "c" is applied to valve V2 changing its state from closed to opened. The closing of valve V1 serves to maintain the isolation of lower portion 37 from the condenser when valve V2 is opened. Opening of valve V2 serves to effect the return to the condenser of condensate that had collected in conduit 45 during the compression stage. Finally, control signal "d" is then applied to valve V3 changing its state from closed to opened, and then back to closed for venting the non-condensable component of the fluid previously trapped in lower portion 37. The cycle ends when valve V1 is again opened, and valve 42 vents upper portion 36.

The actual time of the cycle depends upon the nature of the working fluid, and the physical size of apparatus 30. However, very little experimentation is required to determine the cycle time once a given apparatus is connected to the condenser. The preferred arrangement is for a cycle to have two parts, a first during which fluid from the condenser is transferred to the apparatus, and a second during which compression and venting of the non-condensables takes place. Preferably, the first part of a cycle is about three units of time, and the second is about one unit of time.

Because the non-condensable gases are lighter than the working fluid when an organic fluid is used as the working fluid, the gases will collect in the upper portion of the condenser. Consequently, in such case, it is preferable to connect chamber 31 to the upper portion of the condenser in order to ensure that the maximum amount of non-condensable gases is purged from the condenser.

The orientation of the purging apparatus according to the inventions preferably is as indicated in the drawing with the apparatus being located physically above the condenser to effect a gravitational return of the condensed working fluid into the condenser, and also to permit the lighter non-condensable gases to flow up into the purging apparatus. The non-condensable gases will be lighter than the working fluid when the latter is an organic working fluid. However, the apparatus could be located below the condenser if a pump were available to return the condensed working fluid to the condenser. Furthermore, the present invention is also applicable for purging systems where the non-condensable gases are heavier than the working fluid, e.g., where water or steam is the working fluid.

While the above description of the present invention is associated with a Rankine cycle power plant, the invention is applicable to any system having a condenser in which non-condensable gases are a problem. Examples of other systems to which the present invention is applicable are air conditioning systems and refrigeration systems. Furthermore, the present invention is applicable for use in connection with any system whose performance is adversely affected by the presence of non-condensable gases; and the term "condenser", as used herein, should be interpreted as being indicative of any such system.

In an example of the use of the present invention, a standard diaphragm type thrust cylinder can be used for apparatus 30 providing a ratio of 5:1 (maximum volume of portion 37 to the minimum volume). Suitable cylinders are series 078, Model M-1200-50 double acting diaphragm type manufactured by Ifo Sanitor AB, a Swedish company.

With a condenser pressure of about atmospheric pressure, the maximum pressure in lower portion 37 will be about 100 p.s.i. It is estimated that the period during which the purging apparatus would be operated should be in intervals of about one hour or less. When the working fluid in isopentane, or n-pentane, the preferred material for the diaphragm is textile reinforced nitrile rubber. Vitron, or Teflon diaphragms can also be used.

Although, as disclosed in FIG. 2, the means for moving diaphragm 35 in order to change the volume of closed chamber 34 is shown as including compressed air source 32 and valve 42, other pressurized fluid can be used. For example, pressurized working fluid (liquid or vapor) instead of compressed air can be used for moving the diaphragm in response to control signal "a".

Figure 5:
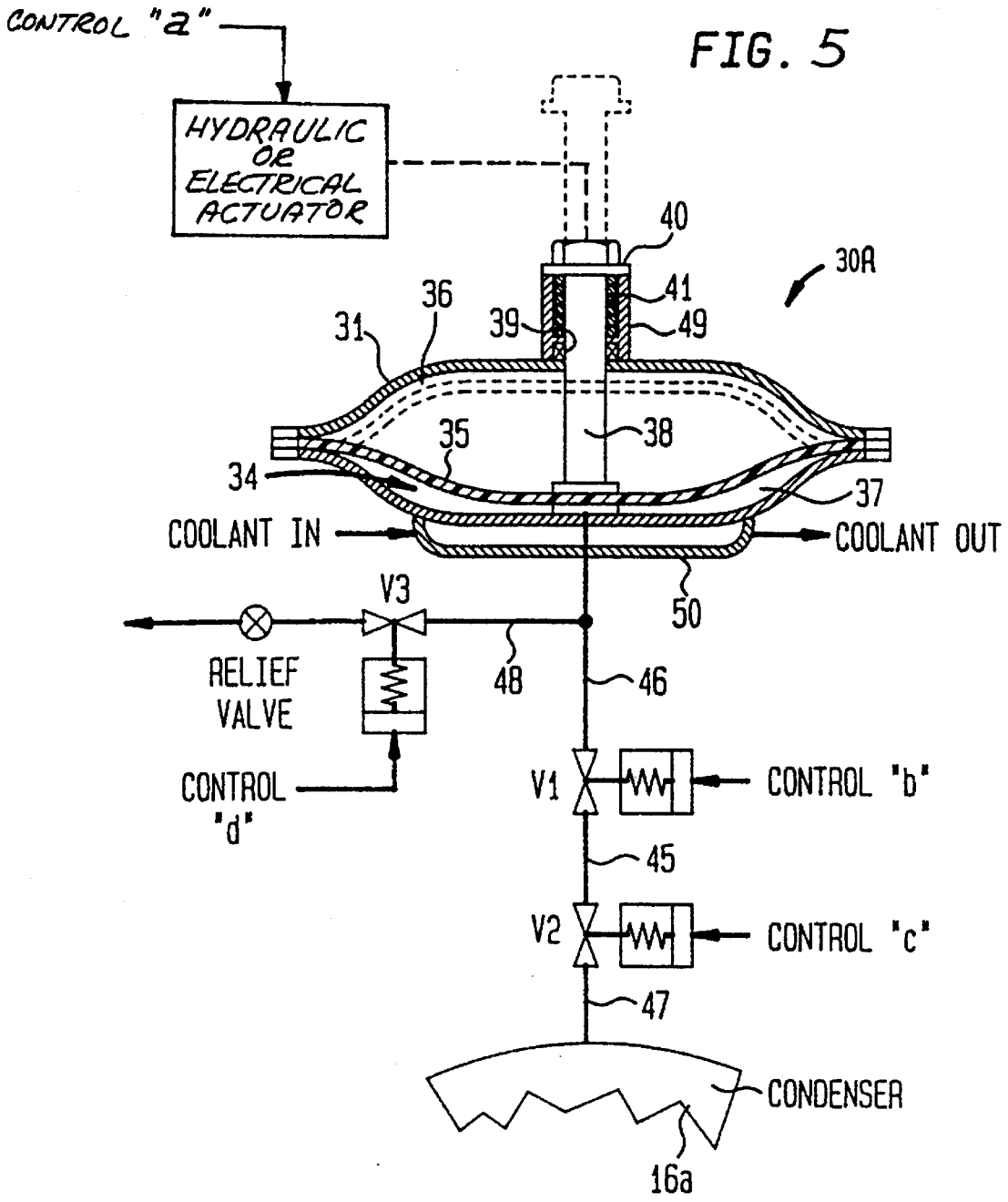
FIG. 5 is a schematic view of the present invention showing electrically or hydraulically operated actuator means for moving a diaphragm that divides the chamber into two portions.

Alternatively, a direct mechanical arrangement can be used to move the diaphragm as shown in FIG. 5. Apparatus 30A, according to the invention, includes suitable electrically operated, or hydraulically operated actuator means mechanically connected to the diaphragm for moving the latter under the control of signal "a". Such actuator means may be double acting in that the actuator moves the diaphragm both upwardly and downwardly thereby making spring 41 is redundant, or may be single acting in that the actuator moves the diaphragm downwardly only, and spring 41 serves to return the diaphragm to its rest position.

The advantages and improved results furnished by the method and apparatus of the present invention are apparent from the foregoing description of the preferred embodiment of the invention. Various changes and modifications may be made without departing from the scope of the invention as described in the appended claims.

We claim:

1. Apparatus for purging non-condensable gases from a source containing vaporized, condensable working fluid, said apparatus comprising:

a) an enclosed chamber located above a connection to said source;

b) a movable, flexible diaphragm in said chamber for dividing the latter into upper and lower portions;

c) two flow control valves serially connected together and located between the said connection and the lower portion of said chamber;

d) a venting valve connected to said lower portion;

e) each of said valves being selectively operable and having an open and a closed state;

f) means for moving said diaphragm in said chamber thereby changing the volume of said lower portion; and g) means for synchronizing the states of the valves with changes in the volume of said lower portion.

2. Apparatus according to claim 1 wherein said working fluid is an organic fluid.

3. Apparatus according to claim 2 wherein said means for moving said diaphragm includes spring means for upwardly biasing said diaphragm in a direction that would increase the volume of said lower portion of said chamber.

4. Apparatus according to claim 3 wherein said means for moving said diaphragm includes a movable operating rod engaged therewith, and means for moving the rod.

5. Apparatus according to claim 1 wherein said chamber and diaphragm are constructed and arranged such that the ratio of maximum to minimum volume of said lower portion is about 5:1.

6. Apparatus according to claim 1 wherein said means for synchronizing is such that said venting valve is in a closed state, and said two flow control valves are each in an open state when the volume of said lower portion is a maximum for effecting entry of fluid from said source into said lower portion, and preventing venting thereof.

7. Apparatus according to claim 6 wherein said means for synchronizing is such that the flow control valve closer to the source is operated to change its state from open to closed when the volume of the lower portion of said chamber begins to decrease from its maximum value in response to downward movement of said diaphragm, while the flow control valve closer to the chamber remains in its open state whereby fluid in said lower portion is compressed as the volume thereof reaches a minimum, and vaporized working fluid in said lower portion condenses to a liquid that flows into the region between the two flow control valves.

8. Apparatus according to claim 7 wherein said means for synchronizing is such that the flow control valve closer to the chamber is operated to change its state from open to closed to disconnect said region from said chamber, and the venting valve is operated to vent the lower portion of the chamber thereby removing non-condensable gases therefrom.

9. Apparatus according to claim 8 wherein said means for synchronizing is such that the flow control valve closer to the source is operated to change its state from closed to open to effect the flow of condensate in the region between the two flow control valves back into the source.

10. Apparatus according to claim 7 wherein said means for synchronizing is such that the flow control valve closer to the chamber is operated to change its state from open to closed to disconnect said region from said chamber, and thereafter the flow control valve closer to said source its state from closed to open to effect the flow of condensate in the region between the two flow control valves back into the source.

11. Apparatus according to claim 10 wherein said means for synchronizing is such that operation of the venting valve is performed after the flow control valve closer to said source changes its state from closed to open and vents the lower portion of the chamber thereby removing non-condensable gases therefrom.

12. Apparatus according to claim 1 including means for cooling the lower portion of said chamber.

13. Apparatus according to claim 1 including a relief valve connected with said venting valve such that the operation of the venting valve removes non-condensable gases from the lower portion of the chamber and substantially prevents the venting of working fluid.

14. Apparatus for purging non-condensable gases from a housing containing vaporized, condensable working fluid, said apparatus comprising:

a) an enclosed chamber located above the housing;

b) a movable, flexible diaphragm in said chamber for dividing the latter into upper and lower portions;

c) two flow control valves serially connected together and located between the said housing and the lower portion of said chamber;

d) a venting valve connected to said lower portion;

e) each of said valves being selectively operable and having an open and a closed state;

f) selectively displaceable actuator means operatively coupled with said diaphragm for selectively displacing the latter to thereby change the volume of said lower portion; and g) means for synchronizing the states of the valves with changes in the volume of said lower portion.

15. Apparatus according to claim 14 wherein said actuator means is electrically operated.

16. Apparatus according to claim 14 wherein said actuator means is hydraulically operated.

17. Apparatus according to claim 14 wherein said housing is a condenser for the working fluid.

18. Apparatus according to claim 14 wherein the working fluid is an organic working fluid.

19. Apparatus according to claim 14 including a relief valve connected with said venting valve such that the operation of the venting valve removes non-condensable gases from the lower portion of the chamber and substantially prevents the venting of working fluid.

20. Apparatus according to claim 14 wherein said means for synchronizing is such that said venting valve is in a closed state, and said two flow control valves are in an open state when the volume of said lower portion is a maximum for effecting entry of fluid from said housing into said lower portion of said chamber, and preventing venting thereof.

21. Apparatus according to claim 20 wherein said means for synchronizing is such that the flow control valve closer to the housing is operated to change state from open to closed when the volume of the lower portion of said chamber begins to decrease from its maximum value in response to downward movement of said diaphragm, while the flow control valve closer to the chamber remains in its open state whereby fluid in said lower portion is compressed as the volume thereof reaches a minimum, and vaporized working fluid in said lower portion condenses to a liquid that flows into the region between the two flow control valves.

22. Apparatus according to claim 21 wherein said means for synchronizing is such that the flow control valve closer to the chamber is operated to change its state from open to closed to disconnect said lower portion from the housing, and thereafter the flow control valve closer to said housing changes its state from closed to open to effect the flow of condensate in the region between the two flow control valves back into the housing.

23. Apparatus according to claim 22 wherein said means for synchronizing is such that operation of the venting valve takes place after the flow control valve closer to said housing changes its state from closed to open vents the lower portion of the chamber thereby removing non-condensable gases therefrom.

24. Apparatus for purging non-condensable gases from a source containing vaporized, condensable working fluid, said apparatus comprising:

a) an enclosed chamber located above a connection to said source;

b) a movable, flexible diaphragm in said chamber for dividing the latter into upper and lower portions;

c) two flow control valves serially connected together and located between said connection and the lower portion of said chamber;

d) a venting valve connected to said lower portion;

e) each of said valves being selectively operable and having an open and a closed state;

f) an operating rod engaged with said diaphragm for moving the same in response to movement of said rod thereby changing the volume of said lower portion;

g) means for moving said rod; and h) means for synchronizing the states of the valves with changes in the volume of said lower portion.

25. Apparatus according to claim 24 wherein said working fluid is an organic fluid.

26. Apparatus according to claim 25 wherein said means for moving said rod includes spring means for upwardly biasing said diaphragm.

27. Apparatus according to claim 24 including means for cooling at least the lower portion of said chamber.

28. Apparatus according to claim 24 wherein said chamber and diaphragm are constructed and arranged such that the ratio of maximum to minimum volume of said lower portion is about 5:1.

29. Apparatus according to claim 24 wherein said means for synchronizing is such that said venting valve is in a closed state, and said two flow control valves are in an open state when the volume of said lower portion is a maximum for effecting entry of fluid from said source into said lower portion of said chamber, and preventing venting thereof.

30. Apparatus according to claim 29 wherein said means for synchronizing is such that the flow control valve closer to the source is operated to change state from open to closed when the volume of the lower portion of said chamber begins to decrease from its maximum value in response to downward movement of said diaphragm, while the flow control valve closer to the chamber remains in its open state whereby fluid in said lower portion is compressed as the volume thereof reaches a minimum, and vaporized working fluid in said lower portion condenses to a liquid that flows into the region between the two flow control valves.

31. Apparatus according to claim 30 wherein said means for synchronizing is such that the flow control valve closer to the chamber is operated to change its state from open to closed to disconnect said lower portion from the source, and the venting valve is operated to vent the lower portion of the chamber thereby removing non-condensable gases therefrom.

32. Apparatus according to claim 31 wherein said means for synchronizing is such that the flow control valve closer to the source is operated to change state from closed to open to effect the flow of condensate in the region between the two flow control valves back into the source.

33. Apparatus according to claim 30 wherein said means for synchronizing is such that the flow control valve closer to the chamber is operated to change its state from open to closed to disconnect said lower portion from the source, and thereafter the flow control valve closer to said source changes its state from closed to open to effect the flow of condensate in the region between the two flow control valves back into the source.

34. Apparatus according to claim 33 wherein said means for synchronizing is such that operation of the venting valve is performed after the flow control valve closer to said source changes its state from closed to open and vents the lower portion of the chamber thereby removing non-condensable gases therefrom.

35. Apparatus according to claim 24 including means for cooling the lower portion of said chamber.

36. Apparatus according to claim 24 wherein said means for moving said rod is fluid actuated.

37. Apparatus according to claim 24 wherein said means for moving said rod is electrically actuated.

38. Apparatus according to claim 24 wherein said means for moving said rod is hydraulically actuated.

39. Apparatus according to claim 24 including a relief valve connected with said venting valve such that the operation of the venting valve removes non-condensable gases from the lower portion of the chamber and substantially prevents the venting of working fluid.

* * * * *